US006000271A

United States Patent [19]

Olsson et al.

[11] Patent Number: 6,000,271

[45] Date of Patent: Dec. 14, 1999

[54] METAL FORMING APPARATUS AND METHOD OF USE

[75] Inventors: Conny Olsson, Fågelmara; Bertil Övgård, Söderåkra; Lars Eriksson, Kalmar, all of Sweden

[73] Assignee: Ap Parts International, Inc., Toledo, Ohio

[21] Appl. No.: 09/227,824

[22] Filed: Jan. 11, 1999

Related U.S. Application Data

[60] Provisional application No. 60/107,336, Nov. 6, 1998.

[51] Int. Cl.[6] ..... B21D 26/02

[52] U.S. Cl. ..... 72/448; 72/57; 72/61; 72/446; 72/455

[58] Field of Search ..... 72/57, 58, 60, 72/61, 446, 448, 455

[56] References Cited

U.S. PATENT DOCUMENTS

| | | | |
|---|---|---|---|
| 2,278,643 | 4/1942 | Braun . | |
| 2,293,287 | 8/1942 | Franz . | |
| 2,314,120 | 3/1943 | Braun . | |
| 2,693,159 | 11/1954 | Taylor . | |
| 3,148,571 | 9/1964 | Wallis . | |
| 3,349,602 | 10/1967 | Nelson . | |
| 3,461,794 | 8/1969 | Schaeffer | 72/448 |
| 3,566,645 | 3/1971 | Lemelson . | |
| 3,910,087 | 10/1975 | Jones . | |
| 4,242,900 | 1/1981 | Dixon . | |
| 4,951,491 | 8/1990 | Lorenz . | |
| 5,085,068 | 2/1992 | Rhoades et al. . | |
| 5,372,026 | 12/1994 | Roper . | |
| 5,415,021 | 5/1995 | Folmer | 72/58 |
| 5,435,163 | 7/1995 | Schäfer . | |
| 5,460,026 | 10/1995 | Schäfer . | |
| 5,533,372 | 7/1996 | Roper et al. | 72/60 |
| 5,628,220 | 5/1997 | Schäfer | 72/61 |
| 5,632,172 | 5/1997 | Käsmacher . | |
| 5,673,470 | 10/1997 | Dehlinger et al. . | |
| 5,711,059 | 1/1998 | Schaefer . | |

FOREIGN PATENT DOCUMENTS

| | | | |
|---|---|---|---|
| WO 95/31322 | 11/1995 | WIPO | 45/17 |

*Primary Examiner*—David Jones
*Attorney, Agent, or Firm*—Dickinson Wright PLLC

[57] ABSTRACT

A metal forming apparatus utilizes the combination of a wedge shaped die half and a complementary shaped cavity in a frame to shape metal blanks. The cavity includes a metal forming mechanism located adjacent a surface adapted to receive a blank to be shaped. The die half is moveable between an inoperative position outside the cavity and an operative position within the cavity. With the die half in the cavity, the metal forming mechanism can apply the necessary force to shape the metal blank in accordance with the die shape. Forming can be attained through the use of pressurized fluid applied against the blank, mechanical or hydraulic ram forces or the like. After shaping is finished, the die half is withdrawn from the cavity, the die half carrying with it the shaped metal part for part recovery and initiation of another forming cycle.

23 Claims, 5 Drawing Sheets

METAL FORMING APPARATUS AND METHOD OF USE

This application claims priority under 35 USC § 119(e) based on provisional application serial No. 60/107,336, filed on Nov. 6, 1998.

FIELD OF THE INVENTION

The present invention is directed to a metal forming apparatus and method and, in particular, to an apparatus utilizing a moving tool assembly which interfaces with an apparatus frame and a metal forming mechanism to form shapes in metal blanks.

BACKGROUND ART

In the prior art, various methods and apparatus have been proposed to shape or form metals, both in the hot or cold state. When forming sheet metal, often times a press is used. The press is usually driven by mechanical or hydraulic action and contains a male die or punch and a female die. In use, a metal blank is placed between the dies and subjected to mechanical or hydraulic press forces by one die being driven against the other die. The dies are appropriately shaped to impart a given shape or form to the metal blank. One particular application of this type of metal forming entails manufacturing the internal and external plates for stamped mufflers.

In place of mechanical or hydraulic forces, high pressure fluid can be employed to form a given metal part. U.S. Pat. No. 5,435,163 to Schafer discloses an apparatus for hydraulically shaping a hollow body. The apparatus includes a stationary base, a die fixed on the base and formed with a cavity having an inner surface and axially oppositely open ends so that a tubular workpiece can be held in the cavity with ends of the workpiece exposed at the cavity ends. A pair of pistons fittable with the workpiece ends are arranged at the cavity ends. Actuators are provided which can displace the pistons toward each other and against the ends of the workpiece in the cavity. The hydraulic liquid is fed at high pressure through one of the pistons to an interior of the workpiece in the cavity to deform the workpiece. The hydraulic shaping described in the Schafer patent is commonly referred to as hydroforming and is often used in the manufacture of exhaust system components, particularly, tubular components.

The metal forming methods described above are not without their disadvantages. First, metal forming presses are extremely expensive, costing as much as $500,000 or more. With this expense, it is often necessary to operate these presses in a batch manner. That is, the presses are employed to produce a large number of pressed parts at one time. The pressed parts are subsequently integrated into a continuous manufacturing line to assemble and/or manufacture a desired component. As an example, stamped mufflers may comprise two internal plates and two external plates. When using a mechanical or hydraulic press, a large number of each of the muffler components are stamped in a batch operation. The stamped plates are then later assembled to form the stamped muffler. With the combination of a batch operation and a continuous operation, manufacturing productivity is compromised. Moreover, given the high rate of speed of mechanical presses, it is difficult to perform a quality control operation after each stamping, i.e., stampings may be done at the rate of one per second. Consequently, total quality control may require intermittent checks at the batch pressing operation and subsequent checks as part of the continuous manufacturing operation, thereby slowing down overall productivity.

Methods and apparatus employing hydroforming techniques are also disadvantageous. Many times, due to the high pressures required to form metal parts, an external force must be applied to the hydroforming dies to assure that they do not separate from the part to be formed. However, since the pressures used in hydroforming are extremely high, e.g., 1500 bar, it is difficult to keep the die halves together without resorting to complex and expensive devices.

The hydroforming and mechanical or hydraulic presses described above also require complex tooling. This tooling not only contributes to increases machinery cost, but requires longer lead times prior to initiating production runs.

In view of the drawbacks of the above-described prior art apparatus used to shape metal, a need has developed to provide an improved metal forming apparatus and method which overcomes the aforementioned disadvantages.

In response to this need, the present invention provides a metal forming apparatus and method which is low in cost so it can be integrated in a continuous production or manufacturing line effectively. The inventive apparatus and method also require simpler tooling to minimize cost and does not require long lead times or the use of external forces other than those required for metal shaping.

SUMMARY OF THE INVENTION

Accordingly, it is a first object of the present invention to provide a metal forming apparatus that can be used as part of a continuous manufacturing line.

Another object of the present invention is to provide a metal forming apparatus which does not require the use of forces other than those necessary for metal shaping.

A still further object of the present invention is to provide a metal forming apparatus which can be compact in size and inexpensive to build to permit its cost effective utilization in a continuous manufacturing or production line.

Yet another object of the invention is an apparatus employing a die configuration which reduces tooling costs and lead times.

One other object of the present invention is to provide a method of forming or shaping a metal blank using an apparatus that does not require forces other than those necessary for shaping.

Other objects and advantages of the present invention will become apparent as a description thereof proceeds.

In satisfaction of the foregoing objects and advantages, the present invention provides a metal forming apparatus comprising a frame having a cavity with first and second surfaces angled with respect to each other to form a wedge shape, the second surface including a metal blank receiving surface. The apparatus includes a die half having another wedge shape complementary to the wedge shape of the cavity.

The die half is moveable between an operative position wherein the die half is within the cavity and an inoperative position wherein the die half is outside of the cavity. A metal forming mechanism or means for metal blank shaping is arranged adjacent the metal blank receiving surface and is adapted to shape a metal blank located on the blank receiving surface when the die half is in the operative position. Metal forming techniques include the use of pressurized fluids, e.g., water, oil or the like in hydroforming or hydropressing processes, the use of mechanical or hydraulic forces via a moving ram or the like or other known or contemplated forming techniques.

The frame can have a solid construction with the cavity therein or be constructed of a plurality of spaced apart plates with opposing structures to form the wedge-forming first and second surfaces. The cavity can have a single opening to receive a blank and the die half or, alternatively, two openings, one to receive the die half and another to permit blank loading for shaping.

The die half is preferably moved between the operative and inoperative positions using rails extending into the cavity and wheels connected to the die half to facilitate die half movement. The die half can be driven manually if desired or by pneumatically, electrically or hydraulically powered drives. The die half movement in and out of the cavity can be controlled to assure proper alignment for blank shaping and timing of the blank processing if the apparatus interfaces with a continuous manufacturing line. The control can be in the form of a stop in or outside of the cavity or a control associated with the die half drive.

In a preferred embodiment, the cavity and die half are arranged for die half movement in a generally horizontal direction with the second surface of the cavity being inclined to mate with a complementary inclined die-containing surface of the die half when in the operative position.

The apparatus can include a continuous or batch receiver positioned to receive the shaped blank as it is removed from the cavity. If desired, one or more of the apparatus can be used to manufacture shaped metal parts as part of a continuous manufacturing line, e.g., exhaust system components or any other multipart system.

The invention also includes the method of forming a metal blank without the need for applying one or more forces other than the actual shaping forces to the dies or die surfaces used for metal shaping. The method includes the steps of providing a metal blank and placing the metal blank on an inclined surface within a cavity of a frame. A die half having an inclined die-containing surface is driven into the cavity so that inclined die-containing surface is adjacent the metal blank. With the blank adjacent the die, a force is applied to an underside of the metal blank in a direction toward the die-containing surface to shape the metal blank. Once the blank is shaped, the die half is removed from the cavity and the shaped metal blank is recovered.

The sequence of steps can be repeated as a batch operation to produce a number of shaped blanks or can be integrated into a continuous manufacturing line to interface with other operations such as trimming, welding, testing, etc.

BRIEF DESCRIPTION OF THE DRAWINGS

Reference is now made to the drawings of the invention wherein.

DESCRIPTION OF THE PREFERRED EMBODIMENTS

Figure 6:
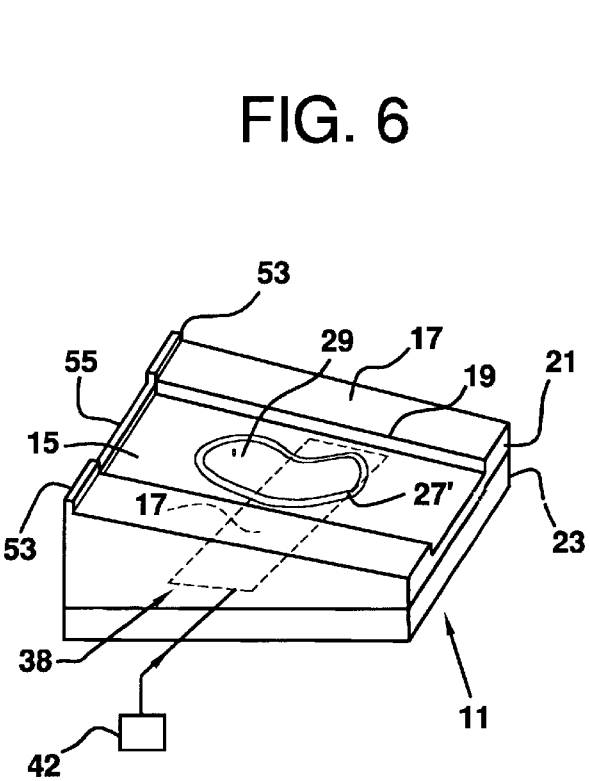
FIG. 6 is a perspective view of a portion of a second embodiment of the invention.

The inventive apparatus and method of use provide a significant advantage over other known apparatus and methods for forming or shaping metal parts or articles. The inventive apparatus provides a cost-effective way in which to shape metal parts as part of a continuous manufacturing or production line. Due to this cost-effectiveness, there is no need to produce a large volume of parts in a batch operation. Moreover, since the inventive apparatus can be used in a continuous production line, quality control can be exercised for each shaped part if so desired without an undue burden on productivity.

The inventive apparatus and method eliminates the need to use external forces to maintain the proper tolerances between die halves and a part to be shaped. With the inventive apparatus, the only forces required are those necessary to shape the metal blank or other starting material.

The invention is also advantageous in that the cost to build the apparatus is far less than that required for a conventional press employing mechanical or hydraulic drive means. By reason of its unique nature, the inventive apparatus has a low tool cost in comparison to conventional apparatus. The low tool cost results in shorter lead times and improved productivity.

A first embodiment of the present invention is depicted in FIGS. 1–5 and is denoted by reference numeral 10.

Figure 1:
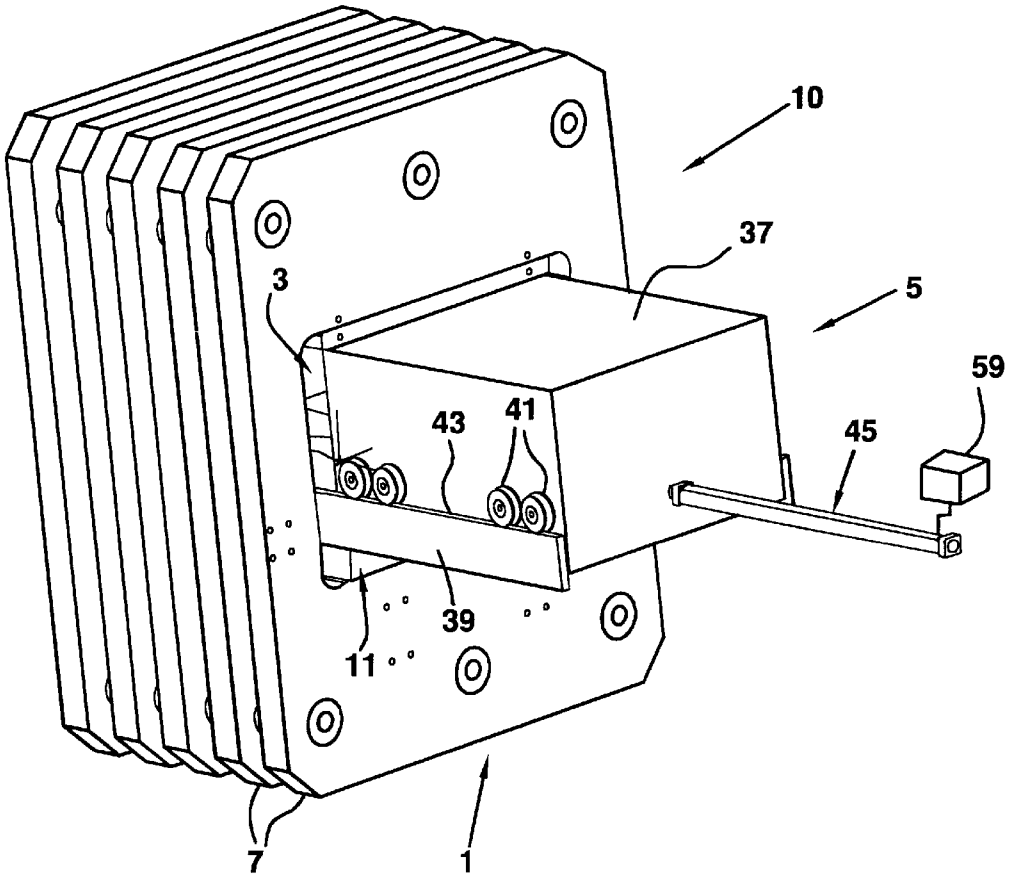
FIG. 1 is a rear perspective view of a first embodiment of the invention.
Figure 2:
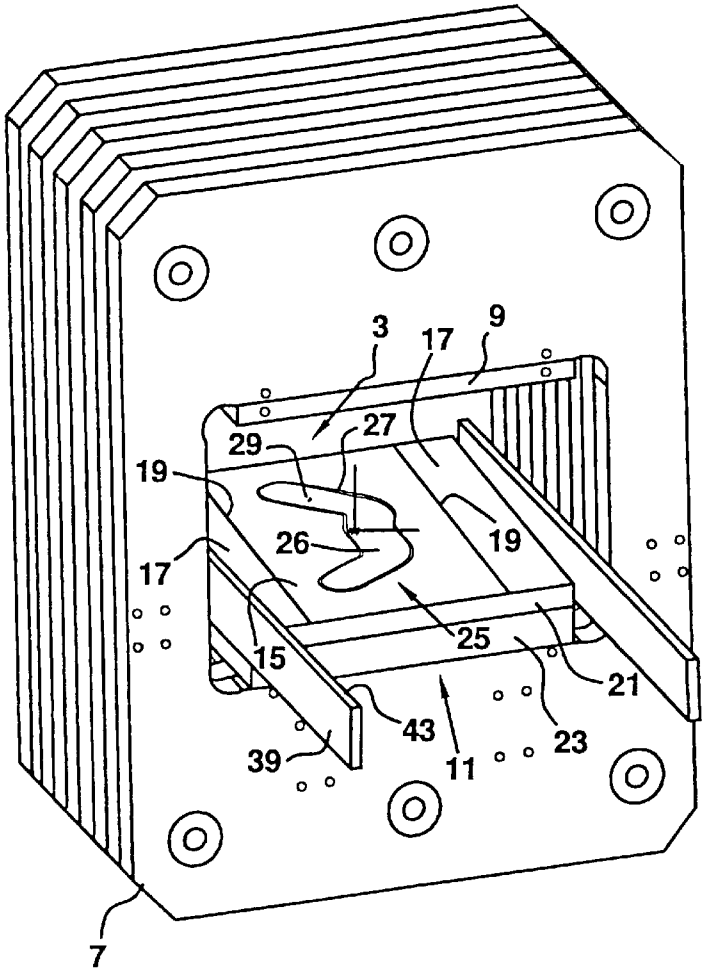
FIG. 2 is a rear perspective view of the embodiment of FIG. 1 without the die half assembly.

With reference to FIGS. 1 and 2, the apparatus 10 comprises a frame 1, a cavity 3 located within the frame and a movable die half assembly 5.

The frame 1 is illustrated as a plurality of a spaced-apart plates 7. The plates are linked together by attachment to an upper plate 9 and a lower plate structure 11, see FIG. 3.

The frame 7 can be free-standing or be supported by legs or other structural members during the actual metal forming operations. By making the frame 1 as a laminar plate structure, weight savings are realized, thereby reducing overall costs of the apparatus. In addition, the laminar plate structure is modular in design so that the number of plates 7 can be varied to change the length of the cavity. For example, one metal blank to be formed may be elongated in shape, thereby requiring that the cavity be longer than it is wider. To accommodate this, the plates 9 and 11 would be made longer and additional plates 7 could be added.

As described in more detail below, the frame could also be constructed of a solid material or of any other construction which will provide an integral structure to withstand the forces applied during metal forming.

Figure 3:
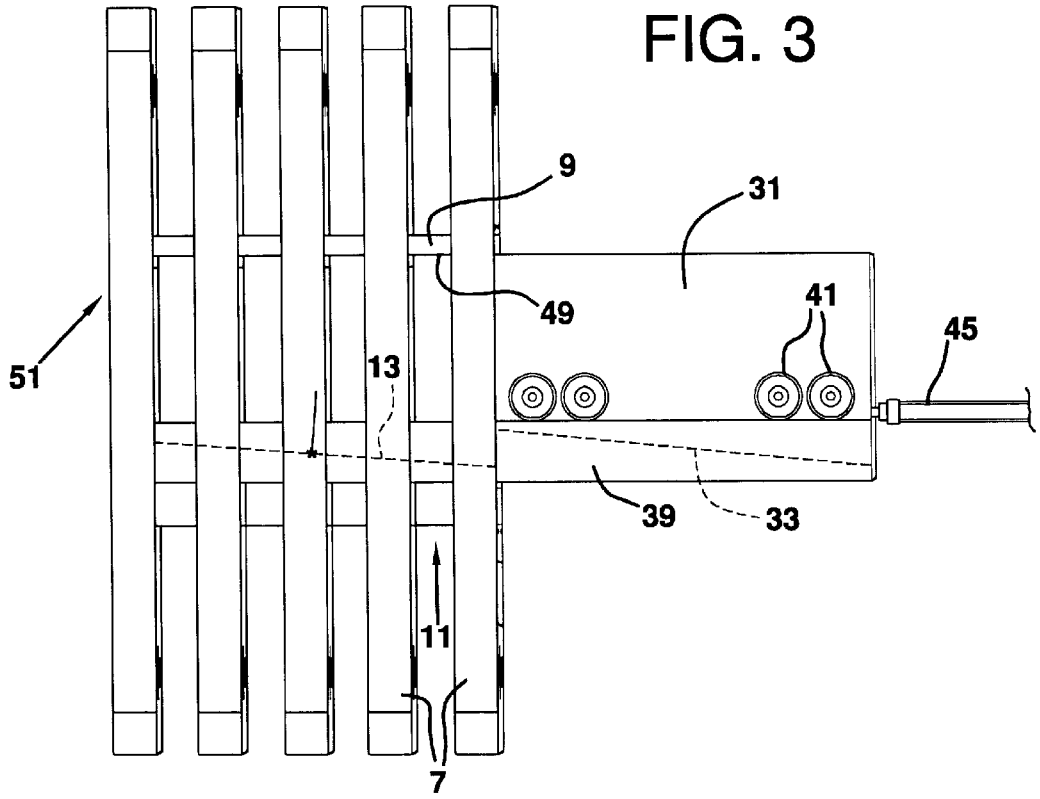
FIG. 3 is a side view of the FIG. 1 embodiment showing the die half in its inoperative position.

Referring to FIGS. 2 and 3, the lower plate 11 has an inclined surface 13 comprising a blank receiving surface 15 situated between surfaces 17. To facilitate blank placement, surface 15 is shown as being recessed from the surfaces 17 whereby lips 19 are formed to hold the blank in place. Of course, other configurations could be employed to accommodate differently-sized or configured blanks.

While the surface 13 is described as being inclined, the inclination may comprise only a portion of the overall surface 13 or encompass the entire surface as shown in FIG. 2. More specifically, the surface may combine portions which are inclined with portions that may be horizontal, depending on the shape of the metal blank before or after shaping. Of course, the surface 13 must still be configured to permit the die half assembly 5 to travel in and out of the cavity 3.

As an alternative to conforming the surfaces 15 and 17 to receive a particular blank, inserts (not shown) could be employed on the surface 15 to align blanks of various shapes so that the lips 19 would not have to be altered for every different metal forming operation. In addition, a planar surface could be used without lips 19 or recesses for receiving the blank, if so desired.

The lower plate 11 is shown divided into halves 21 and 23. The half 21 is removably attached to the lower half 23 using conventional techniques. In this way, half 21 can be changed to accommodate different blank receiving surfaces 15 and different types of metal forming mechanisms as described below. Of course the lower plate structure can be a one piece design.

Referring still to FIG. 2, the blank receiving surface 15 shows a portion 25 of a metal forming mechanism. In FIG. 2, a hydropressing mechanism is illustrated for blank shaping. The mechanism includes a seal 27 following an outline 26 of the shape to be imparted to the blank.

Preferably, the seal 27 is an O-ring type or other flexible type gasket. Any seal capable of withstanding the pressure used in a typical hydroforming or hydropressing operation can be employed.

The metal forming mechanism portion 25 includes an orifice 29 which is positioned within the seal outline 27 to supply pressurized fluid for forming. The source of the pressurized fluid and associated controls are not shown since they are well-known in the art.

The portion 25 of the metal forming mechanism interfaces with the die half assembly 5. More particularly, the assembly 5, referring now to FIGS. 1 and 5, comprises a die half body 31 having a die-containing surface 33. The surface 33 contains a die 35. Opposite the surface 33 is the die half body top surface 37. The die 35 can have any shape for metal forming or a number of die shapes could be utilized.

Rails 39 are mounted within the cavity 3 and extend outwardly therefrom as best seen in FIG. 2. The die half body 31 has wheels 41 which ride along the rail surfaces 43 to permit the die half body 31 to travel in and out of the cavity 3.

The die half body 31 is moved by a drive 45 which can be powered pneumatically, electrically, or hydraulically. The drive 45 could also be operated manually, if desired. The drive 45 moves the die half body into and out of the cavity 3.

Figure 4:
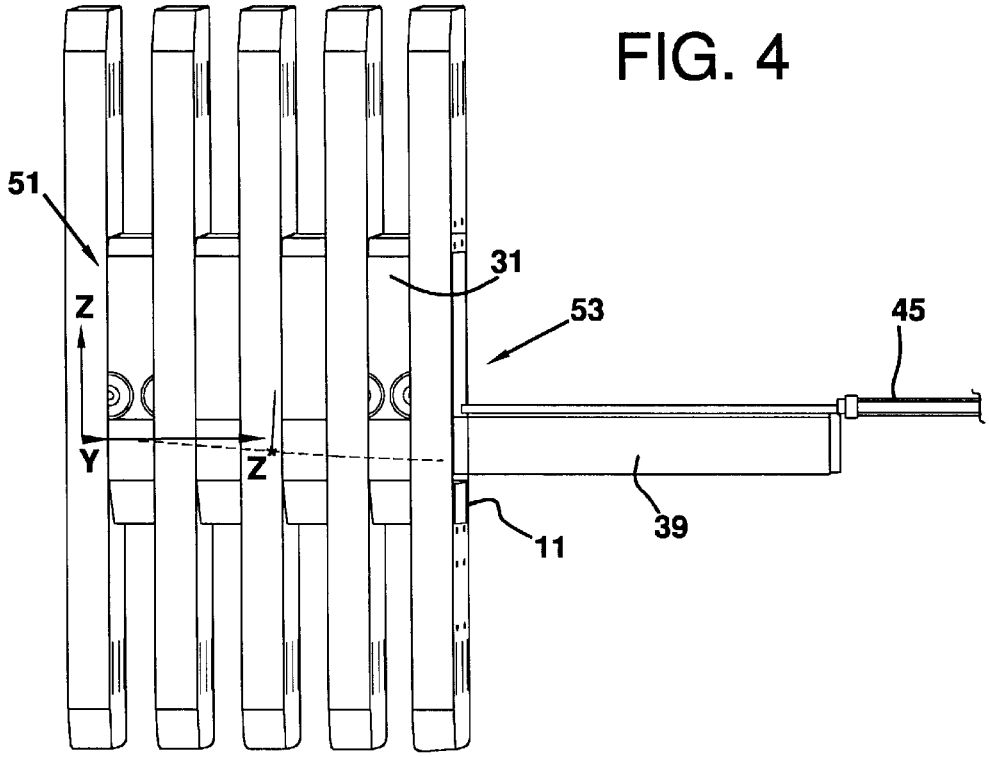
FIG. 4 is a side view of the FIG. 1 embodiment showing the die half in its operative position.
Figure 5:
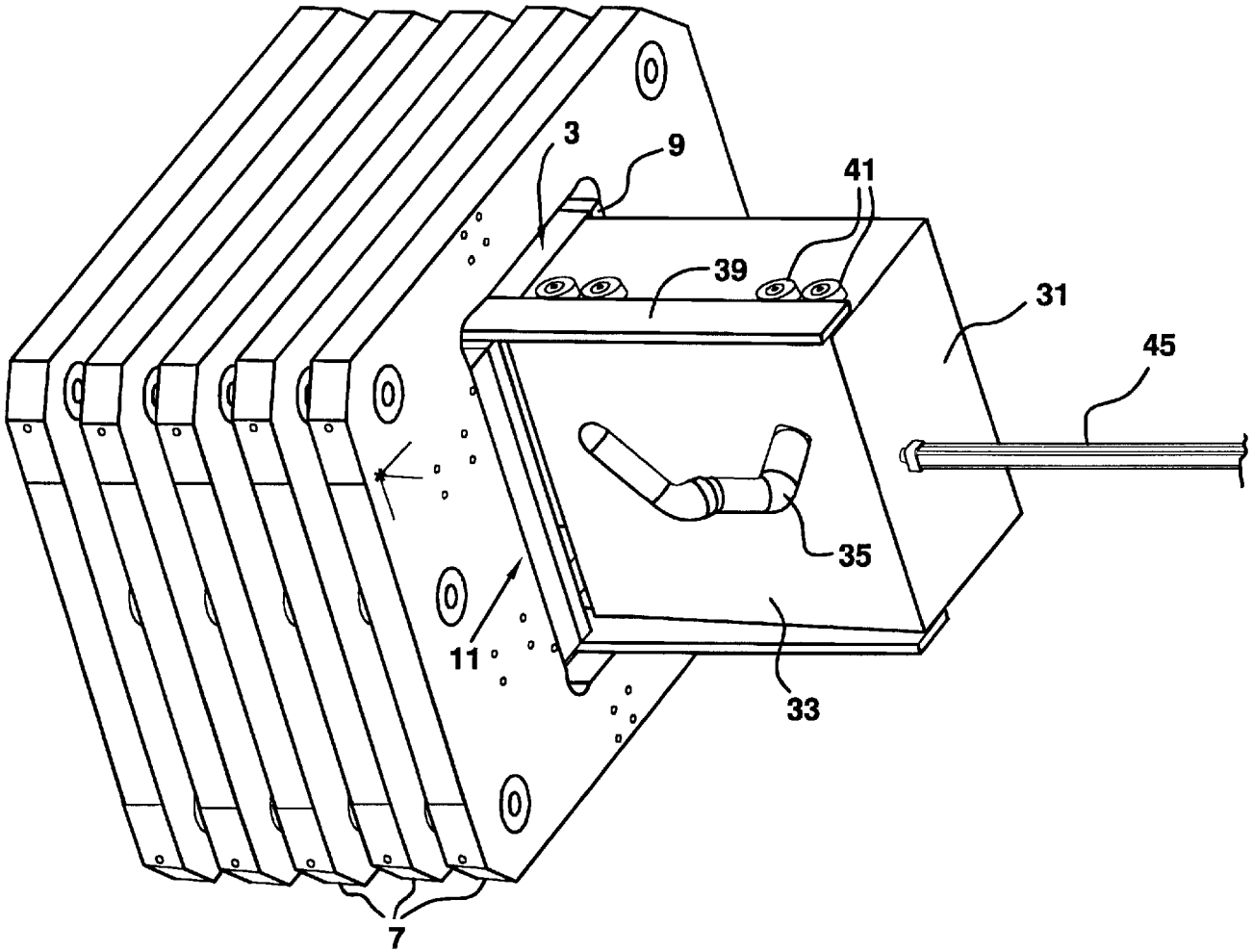
FIG. 5 is a bottom perspective view of a portion of the FIG. 1 embodiment showing the die in the die half.

The die half body 31 is configured to match or be complementary in shape to the configuration of the upper and lower plates, 9 and 11, respectively. As shown in FIGS. 3 and 4, the lower surface 49 of the upper plate 9 and the inclined surface 13 of the lower plate 11 are angled with respect to each other, forming a wedge shape. Similarly, surfaces 37 and 33 of the die half body 31 are angled with respect to each other, also forming a wedge shape complementary to the wedge shape formed by surfaces 49 and 13.

With the complementary shapes between the upper and lower surfaces of the cavity 3 and the upper and lower surfaces of the die half body 31, the die half body 31 nests within the cavity 3 when driven into the operative position. This nesting securely positions the die 35 against a metal blank resting on the receiving surface 15.

When loading blanks for forming, it is preferred that the cavity 3 extend through the plates 7 so as to have a pair of openings 51 and 53, see FIGS. 3 and 4. With a pair of openings, a metal blank may be inserted onto the blank receiving surface 15 via opening 51 and the die half body 31 can travel in and out of the cavity 3 via opening 53. Of course, a single opening could be used whereby charging of the metal blank and entry of the die half body 31 would be done from the single opening.

In operation, referring to FIGS. 2–4, a metal blank to be formed is loaded via opening 51 onto the blank receiving surface 15. The die half body 31, shown in the inoperative position in 3, is driven into the cavity 3 to the operative position as shown in FIG. 4.

By reason of the complementary shape of the die body half 31 and the upper and lower surfaces of the cavity 3, the surface 37 of the die half body 31 is adjacent the surface 49 of the upper plate. Similarly, the die-containing surface 33, by being inclined to match the incline of the surfaces 17 rests against or adjacent the surfaces 17 and the top side of the metal blank.

Thus, the die half body 31 is retained in the cavity 3 and between the upper and lower plates, 9 and 11, respectively. This configuration eliminates the need to employ any other external forces to keep the die-containing surface 33, the metal blank and the metal forming mechanism 25 in intimate contact for proper metal shaping.

With the metal blank in place, pressurized fluid, e.g., water, oil or the like, is applied to its underside via orifice 29. The pressure shapes the blank to follow the contour of the die 35. Once the metal blank is shaped to the desired size, the die half body 31 is returned to its inoperative position by its movement from the cavity 3. The shaped metal blank, a portion thereof, engaging the die 35, is retracted from the cavity along with the die half body 31. When the die half body 31 is retracted from the cavity 3, the shaped metal blank can then drop out of engagement with the die 35 and be collected on a belt or other type of receiver for subsequent processing.

In an alternative to the configuration described above, an external force may be used when the die half body 31 is retained in the cavity 3 in its operative position. Application of such an external force may be used in combination with the application of the metal forming pressurized fluid so as to provide a tight mating between the cavity 3, the die half body 31 and the lower plate 11. Tolerances or clearances may exist between components of the apparatus, e.g., the die half body 31 and the lower plate 11, the die half body 31 and the frame, or the like. It may be desirable to have closer tolerances, i.e., minimal clearances, during the forming operation. These closer tolerances can be obtained by application of an external force other than the hydroforming or hydropressing forces. The external force can be applied using any known or contemplated drives, means or other mechanisms to reduce the clearances/tolerances. For example, a mechanism, driven by fluid pressure, mechanical forces or the like, can be interposed between the plates 21 and 23 shown in FIG. 2 to apply a high force/low stroke movement to one or both plates for clearance reduction. The mechanism is depicted in FIG. 6 and described in more detail below. Of course, other types of mechanisms or means may be utilized to achieve the clearance reduction as would be within the skill of the art.

As stated above, the die 35 can have any shape. The surface 33 could also have other than an inclined planar surface if so desired, e.g., to accommodate a shape already imparted to the blank. Likewise, the upper surface 13 of the lower plate structure 11 could be other than an inclined planar surface. For example, the metal blank to be shaped could already have been partially shaped in a prior operation. Thus, the surface 13 could have a concavity, indentation or other recess or opening to receive the shaped portion of the metal blank. Of course, any recess or other indentation in the surface 13 to receive a shaped portion of the blank is so orientated so that any metal blank that is shaped whereby the metal blank may fill both the die and any indentations in the surface 13 can still be removed in conjunction with retraction of the moveable die half assembly S.

Travel of the die half body 31 within the cavity 3 can be controlled in any number of ways. Referring to FIG. 6, the surfaces 17 of the lower plate 11 can include stops 53. The stops 53 act to prevent the die half body 31 from wedging between the surfaces 49 and 17, thereby making it difficult to remove the die half body 31 when the shaping operation is finished. A stop 55 can also be arranged at the edge of the blank receiving surface 15. The stop 55 assists in alignment of the metal blank when being charged for shaping. FIG. 6 also illustrates an exemplary force applying mechanism 38, powered by a water pressure drive 42, which is expandable for separating plates 21 and 23 and reducing clearances as described above. Movement of plate 21 is shown by the arrow.

In yet another alternative, a control 59 can be associated with the drive 45 to control its travel rather than using mechanical stops within the cavity 3. The control 59 is deemed conventional and does not require further explanation for understanding of the invention.

Stops could also be arranged on the rails 39 rather than the surfaces 17 for die half body 31 travel control. In addition, the rails 39 could be supported by other structure rather than the frame 1, if so desired. In fact, any manner of transport whereby the die half body 31 can travel into and out of the cavity can be utilized. For example, the die half body 31 could include mounted rails or other structure. Wheels or low friction means for rail travel could then be mounted within the frame 1 and/or outside of the frame 1 on the appropriate structure. Other modes of transport as would be within the skill of the art could be utilized to move the die half body 31 within the cavity 3 for metal forming.

Figure 7:
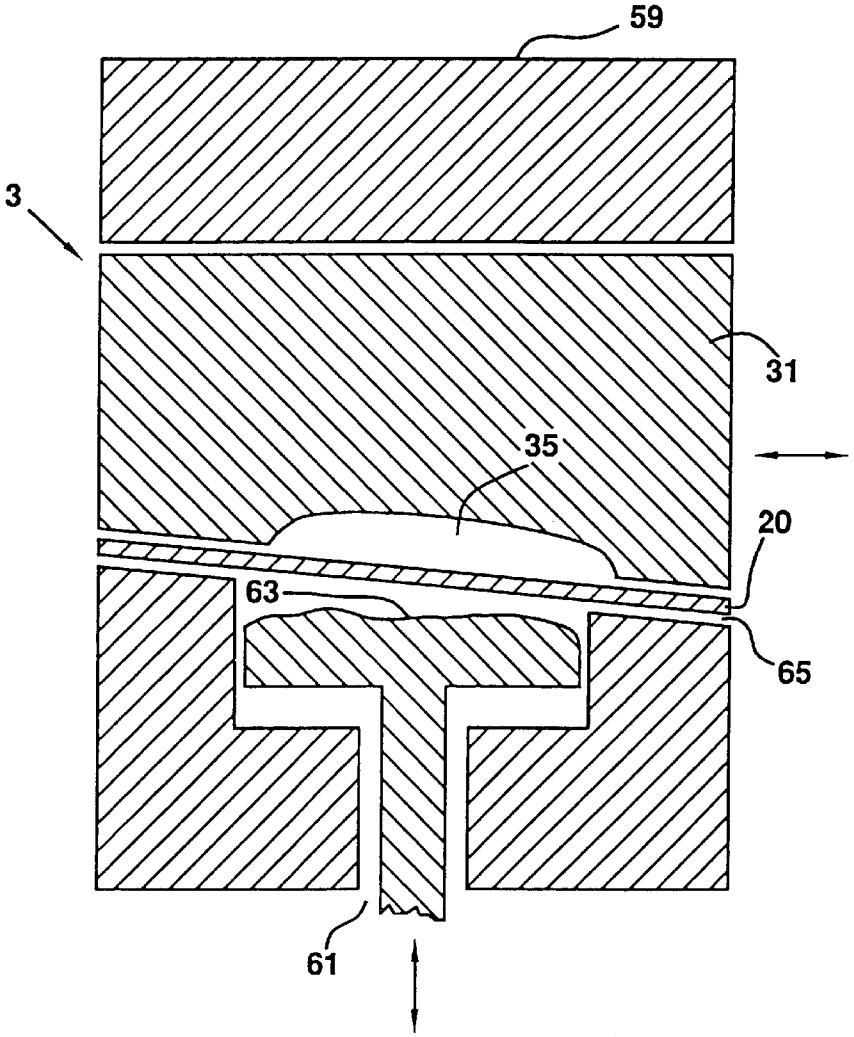
FIG. 7 is a longitudinal cross sectional view of a third embodiment of the invention.

Referring to FIG. 7, another embodiment illustrates a solid construction for the frame and an alternative metal forming mechanism. Instead of the plurality of plates 7 of FIG. 1, a solid block 59 is illustrated to form the cavity 3. In addition, rather than utilizing a hydropressing mechanism, a press or ram mechanism 61 is utilized with a male die 63. The male die 63 is sized to conform with the die 35. The force applied to ram mechanism 61 is provided by a drive (not shown), e.g., a hydraulic, pneumatic or mechanical type, for blank shaping. Since these drives are well-known in the art, a further description thereof is not deemed necessary for understanding of this embodiment of the invention.

In operation of the FIG. 7 apparatus, the blank 20 is placed on the surface 65 of the frame 59. The die half body 31 is then moved within the cavity 3. The ram 61 is then driven to shape the blank 20 so that it conforms to the female die 35. The die half body 31 is then removed from the cavity 3, removal thereof bringing the shaped blank with it so that the blank can be transported for further processing and the procedure can be repeated. Although the frame has been illustrated in terms of a plurality of plates, i.e., a laminar structure, or a solid block construction, the frame can have any cavity-containing shape so that the die half body 31 can wedge with the cavity upper and lower surfaces for metal forming.

In addition, although the cavity is shown with its openings arranged so that the die half body 31 travels in a generally horizontal fashion, the frame could be orientated in any position. For example, the die half body 31 could travel vertically whereby the plane of the cavity openings, 51 and 53, would be generally horizontal rather than the vertical orientation shown in FIGS. 3 and 4. In this adaptation, other means could be employed to facilitate removal of the shaped metal blank after it is retracted from the cavity 3 by the die half body 31. The terms "upper" and "lower" are used to more easily describe the various features of the inventive apparatus and are not considered to be limiting to the particular orientation of the frame 1, cavity 3 and die half assembly 35.

Figure 8:
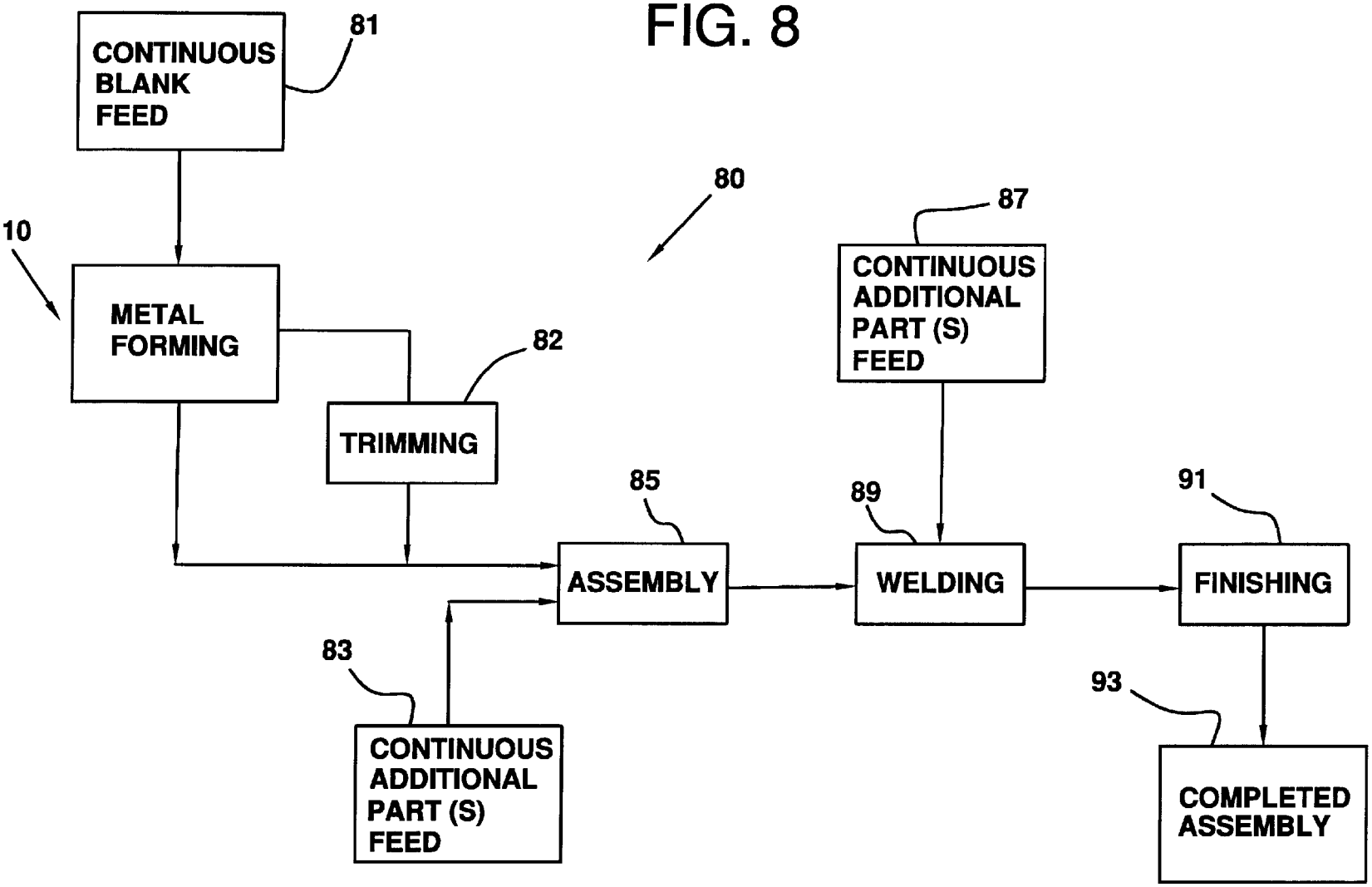
FIG. 8 is a block diagram showing the inventive apparatus as part of a continuous manufacturing line.

One of the significant advantages of the instant invention is the ability to use it as part of a continuous manufacturing or production line. An exemplary manufacturing line 80 is shown in FIG. 8 using the metal forming apparatus 10. The manufacturing line 80 includes a continuous blank feed 81 for the inventive metal forming apparatus 10. The shaped metal part can then be trimmed at trimming operation 82 or directly conveyed to the assembly operation 85. Concurrent with operation of the metal forming apparatus 10, a continuous additional part feed 83 provides another part to the assembly operation 85. The part feed 83 could be another apparatus 10. The shaped blank and the additional part from feed 83 are assembled, e.g., aligning two exhaust system connector halves, and then conveyed to a welding operation 89. A continuous additional part feed 87 supplies another part to the welding operation, e.g., a tube for connection to the connector. Following welding of the tube and connector halves, the welded assembly is finished at 91, e.g., cleaned or the like, and readied for shipment or further processing at 93. The continuous line 80 demonstrates that the inventive apparatus can be effectively used in a continuous line, even if the metal forming operation is not operated at its highest rate.

As stated above, since the metal forming apparatus is low in cost to make, it can be used at a low rate without cost disadvantages. The rate at which the blank is shaped can be matched to the slowest operation in the line 80. For example, the metal forming apparatus could follow the rate of the welding operation so that continuity of the various feeds can be maintained throughout the line operation. As stated above, the manufacturing operation in FIG. 8 is exemplary and other types of operations are equally suited for use with the inventive metal forming apparatus. The apparatus is particularly adapted to shape metal blanks and the like for exhaust system components, e.g., the internal and external plates for stamped mufflers, catalytic converters, pressed detail for these systems, connectors and virtually any other part that requires metal shaping or forming. In addition, the metal forming apparatus can be linked with virtually any other type of operation in a continuous production or manufacturing line.

The metal forming mechanism described above performs the function of forming the metal blank or other article into a desired shape using the particular die(s), seals, outlines and the like once the blank is charged and the die half body 31 is put in the operative position. As stated above, any known means or mechanism, e.g., a press type or pressurized fluid type apparatus, capable of shaping the metal blank in conjunction with the frame and moveable die half assembly 5 is deemed within the scope of the invention.

As such, an invention has been disclosed in terms of preferred embodiments thereof which fulfills each and every one of the objects of the present invention as set forth above and provides a new and improved metal forming apparatus and method.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A metal forming apparatus comprising:

a) a frame having a cavity with first and second surfaces angled with respect to each other to form a wedge shape, the second surface including a metal blank receiving surface;

b) a die half having another wedge shape complementary to the wedge shape of the cavity, the die half being moveable between an operative position wherein the die half is within the cavity and an inoperative position wherein the die half is outside of the cavity; and c) a metal forming mechanism located adjacent the metal blank receiving surface and being adapted to shape a metal blank located on the blank receiving surface when the die half is in the operative position.

2. The apparatus of claim 1, wherein the metal forming mechanism is a hydropressing system and the blank receiving surface includes a seal shaped to correspond to a die shape in the die half.

3. The apparatus of claim 1, wherein the metal forming mechanism is a moveable ram mechanism applying a force to the metal blank for shaping thereof.

4. The apparatus of claim 1, wherein the frame has opposing tracks extending from outside to inside of the cavity and the die half has a plurality of wheels for traveling on the opposing tracks.

5. The apparatus of claim 1, wherein the die half is driven by one of a pneumatic drive, a hydraulic drive and an electrical drive.

6. The apparatus of claim 1, further comprising means to collect the shaped metal blank.

7. The apparatus of claim 1, wherein the frame is one of a solid block or a plurality of spaced apart plates, the spaced apart plates including a first plate containing the first surface and a second base structure containing the second surface.

8. The apparatus of claim 1, wherein the cavity has a pair of openings, one opening for receiving the die half and another opening receiving the metal blank for shaping.

9. The apparatus of claim 1, further comprising means for controlling the travel of the die half into the cavity.

10. The apparatus of claim 9, wherein the controlling means comprises one of a stop located within or outside of the cavity and a drive controller for controlling a drive of the die half.

11. The apparatus of claim 1, wherein the first surface of the cavity is generally horizontal and the second surface thereof is acutely angled with respect to the first surface, an upper surface and a lower die surface of the die half being generally complementary in shape to the first and second surfaces of the cavity.

12. The apparatus of claim 1, wherein the metal forming mechanism includes a force applying mechanism to reduce a clearance between at least the die half and the second surface when the die half is in the operative position.

13. A method of shaping a metal blank comprising the steps of:

a) providing a metal blank;

b) placing the metal blank on an inclined surface of a cavity within a frame;

c) driving a die half having an inclined die-containing surface into the cavity so that the inclined die-containing surface is adjacent the metal blank;

d) applying a force to the metal blank in a direction toward the die-containing surface to shape the metal blank; and e) displacing the die half from the cavity and recovering the shaped metal blank.

14. The method of claim 13, wherein the applied force is one of a pressurized fluid, a hydraulic force and a mechanical force.

15. The method of claim 13, wherein the cavity is formed by a frame having one surface opposing the inclined surface, the one surface and the inclined surface forming a wedge shape, and the die half has a surface opposing the die-containing surface, the surfaces of the die half being complementary to the surfaces of the cavity.

16. The method of claim 13, further comprising controlling the movement of the die half with respect to the inclined surface.

17. The method of claim 13, wherein steps (a)–(e) are performed as part of a continuous manufacturing line.

18. The method of claim 17, wherein a plurality of blanks are processed as steps (a)–(e) for the continuous manufacturing line.

19. The method of claim 13, comprising the step of reducing a clearance present between the die half inclined die-containing surface and the inclined surface of the cavity prior to step (d).

20. A metal forming apparatus comprising:

a) a frame having a cavity with first and second surfaces angled with respect to each other to form a wedge shape, the first surface including a metal blank receiving surface;

b) a die half having another wedge shape complementary to the wedge shape of the cavity, the die half being moveable between an operative position wherein the die half is within the cavity and an inoperative position wherein the die half is outside of the cavity; and c) means for shaping a metal blank located on the blank receiving surface when the die half is in the operative position.

21. The apparatus of claim 20, wherein the means for shaping comprises a source of pressurized fluid in sealed communication with an underside of a metal blank located on the blank receiving surface.

22. The apparatus of claim 20, wherein means for shaping comprises a moveable ram situated for contact with an underside of a metal blank located on the blank receiving surface.

23. The apparatus of claim 20, wherein the mean for shaping includes a force applying mechanism to reduce a clearance between at least the die half and the first surface when the die half is in the operative position.

* * * * *